US009217941B2

(12) United States Patent
Itou et al.

(10) Patent No.: US 9,217,941 B2
(45) Date of Patent: Dec. 22, 2015

(54) METHOD OF MANUFACTURING ERASABLE TONER

(71) Applicant: Toshiba Tec Kabushiki Kaisha, Tokyo (JP)

(72) Inventors: Tsuyoshi Itou, Shizuoka-ken (JP); Kazuhisa Takeda, Shizuoka-ken (JP); Yasuhito Noda, Shizuoka-ken (JP); Takayasu Aoki, Shizuoka-ken (JP); Masahiro Ikuta, Shizuoka-ken (JP); Takafumi Hara, Shizuoka-ken (JP); Motonari Udo, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/152,878

(22) Filed: Jan. 10, 2014

(65) Prior Publication Data

US 2014/0199626 A1 Jul. 17, 2014

(30) Foreign Application Priority Data

Jan. 17, 2013 (JP) ..... 2013-006440

(51) Int. Cl.

| | |
|---|---|
| ***G03G 5/00*** | (2006.01) |
| ***G03G 9/08*** | (2006.01) |
| ***G03G 9/09*** | (2006.01) |
| ***G03G 9/097*** | (2006.01) |

(52) U.S. Cl.

CPC ..... *G03G 9/081* (2013.01); *G03G 9/0815* (2013.01); *G03G 9/0926* (2013.01); *G03G 9/09708* (2013.01); *G03G 9/09716* (2013.01); *G03G 9/09725* (2013.01)

(58) Field of Classification Search

CPC ... G03G 9/0802; G03G 9/081; G03G 9/0815; G03G 9/09725

USPC ..... 430/108.1, 37.1, 137.21

See application file for complete search history.

(56) References Cited

U.S. PATENT DOCUMENTS

| | | | | |
|---|---|---|---|---|
| 8,252,496 | B2 | 8/2012 | Kabai et al. | |
| 2008/0241730 | A1* | 10/2008 | Tuji et al. | 430/137.15 |
| 2011/0183248 | A1 | 7/2011 | Kabai et al. | |

FOREIGN PATENT DOCUMENTS

| | | | |
|---|---|---|---|
| JP | 2006-221040 | * | 8/2006 |
| JP | 2006-330275 | | 12/2006 |
| JP | 2007-058201 | | 3/2007 |
| JP | 2008-280523 | * | 11/2008 |

OTHER PUBLICATIONS

Office Action mailed Nov. 18, 2014, filed in corresponding Japanese Patent Application No. 2013-006440, with English translation.

* cited by examiner

*Primary Examiner* — Thorl Chea

(74) *Attorney, Agent, or Firm* — Patterson & Sheridan, LLP

(57) ABSTRACT

According to one embodiment, a method of manufacturing an erasable toner includes washing toner particles including therein a coloring material that is erasable by heating and a binder resin to obtain a toner cake having the amount of water of 20% by weight to 60% by weight, and drying the toner cake at 40° C. or more and at a temperature which is lower than the complete color erasing temperature of the toner particles by 30° C. or more.

12 Claims, 1 Drawing Sheet

METHOD OF MANUFACTURING ERASABLE TONER

CROSS-REFERENCE TO RELATED APPLICATION

This application is based upon and claims the benefit of priority from Japanese Patent Application No. 2013-006440, filed Jan. 17, 2013, the entire contents of which are incorporated herein by reference.

FIELD

Embodiments described herein relate generally to a method of manufacturing an erasable toner used for an image formation by electrophotography, also more commonly known as photocopying.

BACKGROUND

A toner which contains an erasable, i.e., reversible, coloring material which includes a coloring compound and a developer which interacts with the coloring compound and in which the color is erased, i.e., rendered substantially invisible to the human eye by later heating, is known. By using such a toner, the color image formed using the toner on a recording medium such as paper is erased by heat, and it is thus possible to reuse the recording medium on which the image was formed. Such a technique is considerably effective, from the viewpoint of environmental protection and economic efficiency by reducing the amount of the recording medium used by enabling direct recycling of the recording media for additional image formation thereon.

Such, a toner in which the color is erased by heating is a manufactured by a dry method or a wet method; however, when a kneading and grinding method which is a dry method is used, since when the coloring material described above is melted and kneaded under high shear and under high temperature when mixed with a binder resin, the coloring compound and the color developing material become separately dispersed in the binder resin and the reactions therebetween are resultantly inhibited, and therefore a decrease in the color development density, i.e., the density of the color in the image, of the toner occurs.

In contrast, in a wet method such as an emulsion aggregation method in which toner component fine particles such as the erasable coloring material and the binder resin are aggregated and fused in water to produce toner particles, the coloring compound and the color developing material are not significantly separately dispersed in the resulting toner, and therefore it is possible to prevent a decrease in the color development density in the resulting image.

DETAILED DESCRIPTION

Figure 1:
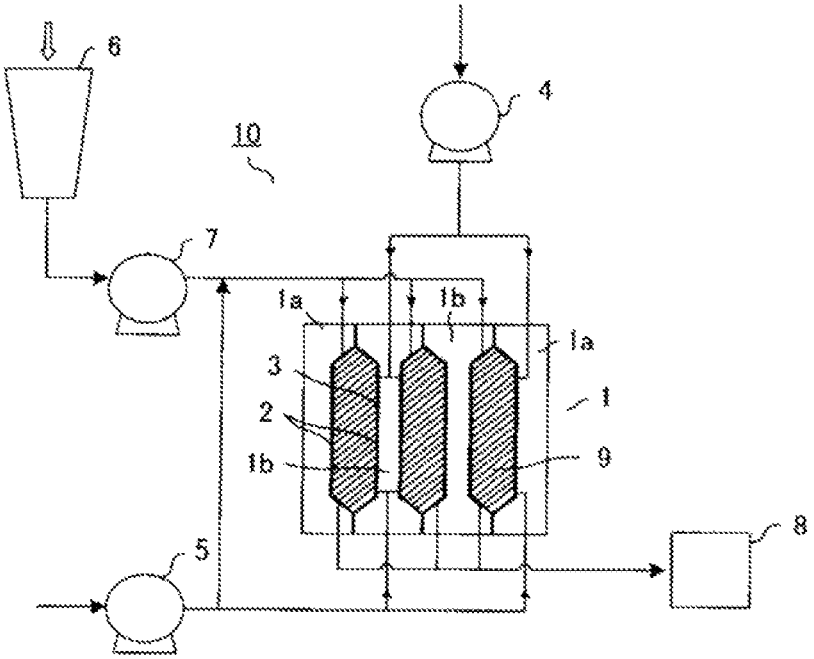
FIG. 1 is a schematic configuration diagram showing an example of a filter press machine used in the present embodiment.

In a wet method of toner preparation, after the solid-liquid separation of the toner particles, it is necessary to dry the toner particles, in order to remove remaining water therefrom. It is desired that the amount of water (the water content) of the toner be reduced as much as possible after the solid-liquid separation by performing heating and drying thereof.

However, as to the toner including the erasable coloring material, there are problems in which the color is erased, i.e., the coloring agent in the toner becomes invisible to the human eye during the drying step, as well as fracturing of toner particles occurs under such manufacturing conditions. As used herein, color refers to a colorant, including traditional colors on the RGB scale, as well as black and white, where the white "color" is to be used to print an image on non-white print media. Additionally, erased refers to a state wherein the colorant or color in the toner has been achromatized or rendered into a state where it is not easily visible to the human eye, although some visible remnant of the color, or of the toner material, may remain, and the underlying toner material remains in place on the print media.

Generally, in the wet method, the uniformity of the particle diameter is relatively high and it is possible to obtain toner particles having a small particle size distribution. However, since the fracturing of toner particles occurs, smaller toner particles are formed, and thus the small particle size distribution of the obtained toner particles degenerates. When such toner particles are used, toner fog, toner scattering, and the like occur when an image is formed, and thus a decrease in the image quality of an image and contamination in an apparatus occur.

Embodiments are made in consideration of the problem described above, and an object thereof is to provide a method of manufacturing an erasable toner in which the toner can be manufactured while preventing the occurrence of the fracturing of toner particles as well as drying toner particles effectively and without erasing the color thereof during manufacturing.

In general, according to one embodiment, a method of manufacturing an erasable toner includes washing toner particles including a coloring material therein that is erasable by heating and a binder resin to obtain a toner cake having the amount of water of 20% by weight to 60% by weight, and drying the toner cake at 40° C. or more and at a temperature which is lower than the complete color erasing temperature of the toner particles by 30° C. or more.

The inventors have performed drying effectively and without erasing the color of the toner during manufacturing by setting the amount of water (the water content) of the toner cake after washing to from 20% by weight to 60% by weight, and drying at 40° C. or more and at a temperature which is lower than the complete color erasing temperature, which is the temperature at which the color of the toner becomes substantially invisible to the human eye, of the toner particles by 30° C. or more in a method of manufacturing the toner in which the image formed therefrom is later erasable by heat. In addition, according to a method of manufacturing of the present embodiment, it is possible to reduce the occurrence of the fracturing of toner particles and in the obtained toner, the content of particles wherein 20% or less have a particle diameter of 2.5 μm or less.

Hereinafter, detailed description will be given of an example of a method of manufacturing an erasable toner of the present embodiment with reference to drawings.

For forming toner particles, it is possible to form toner particles by a wet method such as an emulsion polymerization aggregation method, a suspension polymerization method, and a solvent suspension method. Here, description will be given by taking an example of an emulsion polymerization aggregation method.

Aggregation and Fusion Method

Firstly, a dispersing liquid of the coloring material particles that is erasable by heating is produced. The erasable coloring material contains at least a coloring compound, a developer, and a color erasing agent.

The coloring compound is a precursor compound of a coloring material that later forms a part of a letter, a figure, or the like. As a coloring compound, a leuco dye can mainly be used. The leuco dye-based coloring compound is an electron donating compound having a feature of developing the color when binding with the developer described later and erasing the color when decomposed. For example, diphenylmethane phthalides, phenyl indolyl phthalides, indolyl phthalides, diphenylmethane azaphthalides, phenyl indolyl phthalides, fluorans, styrynoquinolines, and diazarhodamine lactones are included.

Specifically, 3,3-bis(p-dimethylaminophenyl)-6-dimethylaminophthalide, 3-(4-diethylaminophenyl)-3-(1-ethyl-2-methylindol-3-yl) phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminoflouran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino) fluoran, 1,2-benz-6-(N-ethyl-N-isoamylamino)fluoran, 2-(3-methoxy-4-dodecoxystyryl)quinoline, spiro[5H-(1) benzopyrano (2,3-d) pyrmidine-5,1'(3'H)isobenzofuran]-3'-one, 2-(diethylamino)-8-(diethylamino)-4-methyl,spiro[5H-(1)benzopyrano(2,3-d)pyrimidine-5,1'(3'H)isobenzofuran]-3'-one, 2-(di-n-butylamino)-8-(diethylamino)-4-methyl, spiro[5H-(1)benzopyrano (2,3-d) pyrimidine-5,1'(3'H) isobenzofuran]-3'-one, 2-di-n-butylamino)-8-(diethylamino)-4-methyl,spiro[5H-(1)benzopyrano(2,3-d) pyrimidine-5,1'(3'H) isobenzofuran]-3'-one, 2-(di-n-butylamino)-8-(N-ethyl-N-isoamylamino)-4-methyl,spiro[5H-(1) benzopyrano (2,3-d) pyrimidine-5,1'(3'H) isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, 3-(2-ethoxy-4-diethylaminophenyl)-3-(1-pentyl-2-methylindol-3-yl)-4,5,6,7-tetrachlorophthalide, and the like are included. Furthermore, a pyridine-based, quinazoline-based, and bisquinazoline-based compound, and the like are included. The above compounds can be used alone or in a combination or two or more types.

The developer is an electron, accepting compound which gives, i.e., provides, a proton to the coloring compound. As a developer, for example, phenols, phenol metal salts, carboxylic acid metal salts, aromatic carboxylic acid, aliphatic carboxylic acid having 2 to 5 carbon atoms, benzophenones, sulfonic acid, sulfonic acid salts, phosphoric acids, phosphoric acid metal salts, acidic phosphoric esters, acidic phosphoric ester metal salts, phosphorous acids, phosphorous acid metal salts, monophenols, polyphenols, 1,2,3-triazole and a derivative thereof, and the like are included. Furthermore, as a substituent thereof, an alkyl group, an aryl group, an acyl group, an alkoxycarbonyl group, a carboxy group and an ester thereof, or a group containing an amide group, a halogen group, and the like, bis-type and tris-type phenol, and the like, a phenol-aldehyde condensation resin, and the like, and furthermore, a metal salt thereof are included.

Specifically, phenol, o-cresol, t-butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or a ester thereof, for example, 2,3-dihydroxybenzoic acid, methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenyl sulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl) n-octane, 1,1-bis (4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl) ethylpropionate, 2,2-bis(4-hydroxyphenyl)-4-methylpentane, 2,2-bis(4-hydroxyphenyl) hexafluoropropane, 2,2-bis(4-hydroxyphenyl)n-heptane, 2,2-bis(4-hydroxyphenyl)n-nonane, 2,4-dihydroxy acetophenone, 2,5-dihydroxy acetophenone, 2,6-dihydroxy acetophenone, 3,5-dihydroxyacetophenone, 2,3,4-trihydroxy acetophenone, 2,4-dihydroxy benzophenone, 4,4'-dihydroxy benzophenone, 2,3,4-trihydroxy benzophenone, 2,4,4'-trihydroxy benzophenone, 2,2',4,4'-tetrahydroxy benzophenone, 2,3,4,4'-tetrahydroxy benzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4'4"-ethylidene trisphenol, 4,4'-(1-methylethylidene) bisphenol, methylene tris-p-cresol, and the like are included. The above compounds can be used alone or in a combination of two or more types.

A well-known color erasing agent can be used as long as the color erasing agent is a compound which reverses the color developing reaction by the coloring compound and the developer using beat to be able to achromatize in the three components system of the coloring compound, the developer and the color erasing agent. As an aspect of a color erasing agent, there is an aspect in which a component that develops the color by binding the coloring compound and the developer, and a component of the color erasing agent are dispersed in a medium which has a less or no color developing and color erasing effect, an aspect in which a component of the color erasing agent is used for a medium of a component in which the coloring compound binds to the developer to develop the color, and the like.

For the color erasing agent used in the latter aspect, particularly, the color forming or developing and color erasing mechanism using the temperature hysteresis of a discoloring temperature regulating agent which is well-known in JP-A-60-264285, JP-A-2005-1369, JP-A-2008-280523, or the like is superior in terms of the instant erasability. In the mechanism, by using a substance which is called a discoloring temperature regulating agent in which the difference between a melting point and a freezing point is large, the color is erased when heating to the melting point of the discoloring temperature regulating agent or more and the state of color erasing is maintained until reaching the freezing point of the discoloring temperature regulating agent (in one example, the freezing point is about −20° C.). As a result, the coloring material will be maintained in the color erased state even at normal temperatures when the freezing point of the discoloring temperature regulating agent is less than the normal temperature. Thus, if the freezing point of the discoloring temperature regulating agent is below a normal minimum ambient temperature, so long as the printed material having the erasable toner thereon in the erased state is not exposed to a temperature below that normal minimum ambient temperature, the toner on the printed material will remain in the erased state.

In other words, when the mixture (the coloring material) of the three components system in which the color is developed is heated up to the specific color erasing temperature (Th) or more, it is possible to erase the color, and even though the mixture in which the color is erased is cooled to the temperature of Th or less, the color erased state of the mixture is maintained. Furthermore, when the temperature decreases, at the specific re-coloring temperature (Tc), the temperature at which the erased image returns, or lower, it is possible to reverse the reversible color developing and color erasing reaction in which the color developing reaction by the coloring compound and the developer is reactivated again to return to the state where the color or image is again visible to the human eye. Particularly, it is preferable that the discoloring temperature regulating agent used in the present embodiment satisfies a relationship of Th>Tr>Tc when a room temperature is set to Tr.

The discoloring temperature regulating agent capable of causing the temperature hysteresis, for example, includes alcohols, esters, ketones, ethers, and acid amides which are well-known in publications described above. Among these, esters are particularly preferable.

Specifically, carboxylic acid ester including a substituted aromatic ring, ester of carboxylic acid and aliphatic alcohol including an unsubstituted aromatic ring, carboxylic acid ester including a cyclohexyl group in a molecule, ester of fatty acid and unsubstituted aromatic alcohol or phenol, ester of fatty acid and branched aliphatic alcohol, ester of dicarboxylic acid and aromatic alcohol or branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, distearin, and the like are included. The above compounds can be used alone or in a combination of two or more kinds.

In the present exemplary embodiment, in order to improve the color developing and color erasing effect, it is preferable that a core component including the coloring compound, the developer, and the color erasing agent is encapsulated by a shell component. By encapsulating, the color developing and color erasing effect is improved.

As a method of encapsulating, an interfacial polymerization method, a coacervation method, an in-situ polymerization method, a drying method in liquid, a cured coating method in liquid, and the like are included. Particularly, an in-situ polymerization method in which a melamine resin is used as a shell component and an interfacial polymerization method in which a urethane resin is used as a shell component are preferable. In a case of an in-situ polymerization method, firstly, the coloring compound, the developer, and the color erasing agent are dissolved and mixed to be emulsified in a water-soluble polymer or a surfactant aqueous solution. Thereafter, it is possible to encapsulate the core component by adding a melamine formalin prepolymer aqueous solution to heat and polymerize. In a case of an interfacial polymerization method, three components described above and a multivalent isocyanate prepolymer are dissolved and mixed to be emulsified in a water-soluble polymer or a surfactant aqueous solution. Thereafter, it is possible to encapsulate the core component by adding a multivalent base such as diamine and diol to heat and polymerize.

Next, a dispersing liquid of the erasable coloring material fine particles and a dispersing liquid of fine particles containing the binder resin are mixed. Further, when mixing, an aggregating agent such as aluminum sulfate is added to aggregate fine particles with each other by heating, as necessary. As necessary, it is preferable that the temperature be gradually increased up to approximately 100° C. with stirring, and fusion of the aggregated particles is promoted, after adding a fusion stabilizing agent such as a sodium polycarboxylate aqueous solution.

As a binder resin, a polyester-based resin which is obtained by polycondensing a dicarboxylic acid component with a diol component through an esterification reaction is preferable. The glass transition temperature in a styrene-based resin is generally higher, compared with a polyester-based material, the styrene-based resin has a disadvantage in a viewpoint of the low temperature fixing. As an acid component, for example, aromatic dicarboxylic acid such as terephthalic acid, phthalic acid, and isophthalic acid, and aliphatic carboxylic acid such as fumaric acid, maleic acid, succinic acid, adipic acid, sebacic acid, glutaric acid, pimelic acid, oxalic acid, malonic acid, citraconic acid and itaconic acid, and the like are included. As a diol component, for example, aliphatic diol such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol, alicyclic diol such as 1,4-cyclohexane diol and 1,4-cyclohexane dimethanol, ethylene oxide such as bisphenol A, a propylene oxide adduct, and the like are included. In addition, the polyester component described above may be formed into a crosslinked structure using multivalent carboxylic acid having a valance of 3 or more such as 1,2,4-benzene tricarboxylic acid (trimellitic acid) and glycerin, or a multivalent alcohol component. The above components may be used alone or may be used in a combination of two or more kinds of polyester resins in which compositions are different. The polyester resin may be amorphous and crystalline.

The glass transition temperature of the polyester resin is preferably from 40° C. to 70° C. If the glass transition temperature is lower than 40° C., unification or fusing between toner particles occurs during drying. On the other hand, if the glass transition temperature is higher than 70° C., the fixability of the toner to form an image therewith degenerates. A glass transition temperature from 45° C. to 65° C. is even more preferable.

A well-known component such as a polymerizable monomer, a chain transfer agent, a crosslinking agent, a polymerization initiator, a surfactant, an aggregating agent, a pH regulator, an antifoam agent, an electrostatic charge controlling agent, and a parting agent which can be used as a toner component in the present embodiment can be added to the fine particles containing the binder resin, in addition to the binder resin described above.

Washing Step

Next, the aggregated and fused toner particles are washed by an aqueous medium such as water. As a washing method which can be used in the present embodiment, a centrifugation method, a filter press method, and the like are included.

Among these, a filter press method is particularly preferable since an air blow can be performed while compressing, and thus the amount of water (the water content) of the toner cake after washing is easily set to the predetermined range.

Hereinafter, detailed description will be given of a filter press method with reference to FIG. 1.

FIG. 1 is an outline configuration diagram showing an example of a filter press machine.

As shown in FIG. 1, a filter press 10 is provided with a plurality of filter chambers 1 in which the toner may be washed and dehydrated, and the filter chamber 1 has a configuration in which a filter cloth 2 and a compressing sheet 3 are inserted between two filter plates such as plates 1*a* and 1*b*, or adjacent plates 1*b*, 1*b*. An air supply port which supplies air from an air compressor 4 to the compressing sheet 3 and a washing water supply port which supplies washing water through a liquid delivery pump 5 are provided on the side where the compressing sheet 3 of the filter chamber 1 is arranged. On the other hand, a toner supply port which supplies the toner particles dispersed in liquid from a toner store unit 6 through a liquid delivery pump 7 and a filtrate discharge port which discharges the filtrate to a discharge unit 8 are provided on the opposite side of the compressing sheet 3. The toner supply port serves as the washing water supply port as necessary.

The toner particles and liquid dispersed from the toner store unit 6 is supplied to the filter chamber 1. The filtrate which passes through the filter cloth 2 is sent to the discharge unit 3 from the filtrate discharge port. When the filtrate which is discharged contains toner particles, the filtrate which is discharged from the filtrate discharge port or the filtrate which is sent to the discharge unit 8 is returned via the toner supply port to the filter chamber 1 to be refiltrated, as necessary.

Next, by supplying ion-exchange water from the washing water supply port of the lower part of the filter chamber 1 by the liquid delivery pump 7, a cake 9 of toner particles is washed. Since ion-exchange water which is supplied from the washing water supply port is supplied from the whole back surface of the filter cloth 2 to the toner cake, ion-exchange water is spread over the entire toner cake, and thus it is possible to uniformly wash the toner cake without uneven washing. Ion-exchange water which has been used for washing passes through the filter cloth 2 and is sent to the discharge unit 8.

Thereafter, the compressing sheet is used to compress the washed toner. Air pressure supplied from the air compressor 4 is applied against the outer side of the compressing sheet 3, to compress and dehydrate the washed toner cake in a cavity of the filter press. Further, washing may be conducted while compressing the toner cake. In addition, by supplying air to the filter chamber 1, it is possible to further reduce the amount of water from the toner cake after compressing and dehydrating, as necessary.

The compression pressure of a filter press before application of air pressure to the compression plates 3 is preferably from 0.05 MPa to 0.4 MPa. If the compression pressure is smaller than 0.05 MPa, since washing is insufficient, an image defect such as toner fog occurs. On the other hand, if the pressure is greater than 0.4 MPa, since the fracturing of the toner particles occur by pressure, a resulting image defect such as toner fog occurs. Compression pressure of 0.1 MPa to 0.3 MPa is more preferable.

The amount of water (the water content) of the toner cake 9 after washing and dehydrating by the washing step needs to be from 20% by weight to 60% by weight. If the amount of water is less than 20% by weight, fracturing and pulverizing of the toner particles will occur, and thus toner scattering or the like will occur when developing the image using the toner, or the like. On the other hand, if the amount of water is more than 60% by weight, in the drying step, drying takes too long and the toner deteriorates due to the heat history by heating and drying the toner particles for a long period of time.

Toner cake 9 having the amount of water of the above-described range is discharged by opening the filter plates 1*a* (1*b*) and 1*b*. The discharged toner cake 9 is, as appropriate, roughly ground and used for the drying step.

(Drying Step)

The toner cake resulting after the washing step is dried until the amount of water (the water content) in the toner particles reaches from 0.1% by weight to 2.0% by weight. As a drying method which can be used in the present embodiment, a tray type decompression drying method, Nauta type decompression drying method, Conical type decompression drying method, a vibrating fluid method, a flash jet method, and the like are included. Among these, particularly, a flash jet method is preferable based on excellent productivity.

Hereinafter, detailed description will be given of a flash jet method with reference to FIG. 2.

Figure 2:
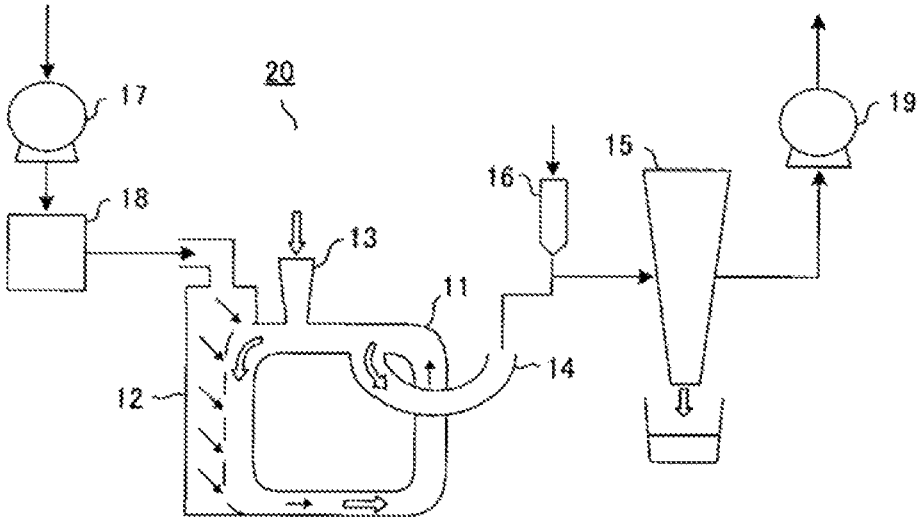
FIG. 2 is a schematic configuration diagram showing an example of a flush jet dryer machine used in the present embodiment.

FIG. 2 is an outline configuration diagram showing an example of a flush jet dryer machine used in present embodiment. As shown in FIG. 2, a flash jet dryer machine 20 is provided with an annular pipe 11, a hot air blasting port 12 for blasting hot air into the annular pipe 11, a toner supply port 13 into which toner particles are put, and a toner discharge port 14 which discharges the toner from which the water is evaporated. The toner discharge port 14 is connected to a toner recovery container 15 with a pipe and an airflow supply unit 16 that supplies airflow for decreasing the temperature of hot air which is discharged from, the toner discharge port 14 is provided on the pathway of the pipe from the toner discharge port 14 to the toner recovery container 15.

Hot air supplied from the hot air blasting port 12 is supplied from a suction blower 17 through a heating apparatus 18. In the heating apparatus 18, the hot air temperature is adjusted so that the hot air temperature in the annular pipe 11 is a temperature which is lower by 30° C. or more, with respect to the complete color erasing temperature of the erasable toner to be dried. If the hot air temperature is higher than a temperature which is lower by 30° C. or more, with respect to the complete color erasing temperature of the erasable toner to be dried, the temperature to which the toner is elevated to by the hot air is less than the complete color erasing temperature of the toner.

The air speed of the hot air in the annular pipe 11 is preferably from 20 m/s to 100 m/s. If the air speed is less than 20 m/s, it is hard to reach the desired amount of water in the dried toner to 2% by weight or less. On the other hand, if the air speed is larger than 100 m/s, since the fracturing of the toner occurs, the resulting image will have defects such as toner fog. An air speed of from 25 m/s to 50 m/s is more preferable. In addition, it is preferable that the feed amount (the supplied amount) of the toner is adjusted in a range of from 1 $g/m^3$ to 15 $g/m^3$ per unit airflow, from the viewpoint of drying efficiency.

The toner supplied from the toner supply port 13 is circulated with hot air supplied from the hot air blasting port 12 in the annular pipe 11. Since the toner having large amount of water experiences a high centrifugal force, the toner is circulated toward the inner walls of the annular pipe 11. The toner which becomes lighter since the water is gradually evaporated therein experiences a lower centrifugal force, and thus the toner is circulated toward the center of the annular pipe 11. Afterward, the dried toner is discharged with hot air from the toner discharge port 14 arranged to open adjacent to the center of the annular pipe 11. The discharged toner is transported to the toner recovery container 15 with airflow which is supplied from the airflow supply unit 16. In the present embodiment, the amount of water in the dried toner collected at the toner recovery container 15 is in a range of from 0.1% by weight to 2.0% by weight. Further, hot air or the like which is supplied to the toner recovery container 15 is discharged from an exhaust blower 19.

External Adding Step

In order to adjust the liquidity or electrification characteristics of the toner particles obtained through the drying step described above, from 0.01% by weight to 20% by weight of inorganic fine particles may be added thereto, with respect to the toner particles, as necessary. As such inorganic fine particles, silica, titania, alumina, strontium titanate, tin oxide, and the like can be used alone or by mixing two or more types thereof. It is preferable that inorganic fine particles are used on which a surface treatment is conducted by a hydrophobizing agent, from the viewpoint of an improvement of environmental stability. In addition, resin fine particles which are 1 μm or less other than such inorganic fine particles may be externally added for an improvement of cleaning performance of the toner from multi-functional peripheral or copying machine.

As to the erasable toner obtained through the treatment as described above, since the particles having the particle diameter of 2.5 μm or less measured by a coulter method (the aperture diameter 50 μm; the measured lower limit diameter 1.0 μm) is 20% or less, it is possible to obtain the erasable toner in which the occurrence of fine powder is prevented and which has an excellent narrow particle size distribution.

The erasable toner of the present embodiment obtained in this way, for example, is accommodated in a toner cartridge, is loaded on the image forming apparatus such as an MFP (multi-functional peripheral) provided with a system in which fixing of the image is achieved by heating, and is used for image formation by electrophotography.

In addition, the erasable toner of the present embodiment is used in a system in which the color is erased at a color erasing temperature which is higher than the fixing temperature.

EXAMPLES

Hereinafter, the present embodiment will be described in more detail showing specific examples. Further, unless otherwise specified, '%' and 'part' are based on weight in the following description.

Production or Color Developing Particle A Dispersion

A component including 1 part of 3-(2-ethoxy-4-diethylaminophenyl)-3-(1-ethyl-2-methylindol-3-yl)-4-azaphthalide as a coloring compound, 5 parts of 2,2-bis(4-hydroxyphenyl) hexafluoropropane as a developer, and 50 parts of a diester compound of pimelic acid and 2-(4-benzyloxyphenyl) ethanol as a discoloring temperature regulating agent was heated and dissolved, and further was mixed with 20 parts of an aromatic multivalent isocyanate prepolymer and 40 parts of ethyl acetate as an encapsulated agent.

After the obtained solution was put into 250 parts of 8% polyvinyl alcohol aqueous solution, emulsified and dispersed, and continuously stirred for about 1 hour at 90° C., 2 parts of water-soluble aliphatic modified amine was added as a reactant and further continuously stirred for about 3 hours with maintaining a solution temperature at 90° C. to obtain colorless capsule particles. The dispersion of the obtained capsule particles was put into a cooled enclosure to cause the color to appear at about −20° C., and a blue color developing particle A dispersion was obtained. When the color developing particles A were measured by SALD7000 manufactured by Shimazu Corporation, the volume average particle diameter thereof was 2 μm.

Production of Toner Component Particle R Dispersion

After 94 parts of a polyester resin as a binder resin (having a glass transition temperature (Tg) of 45° C. and a softening point (Tm) of 100° C.), 5 parts of rice wax as a parting agent, and 1 part of TN-105 (manufactured by HODOGAYA CHEMICAL CO., LTD.) as an electrostatic charge controlling agent were uniformly mixed by a dry mixer, the mixture was melted and kneaded at 80° C. by PCM-45 (manufactured by Ikegai Iron Works Co., Ltd.) which is a double screw mixer. The obtained toner composition was ground into 2 mm mesh size by a pin mill to obtain a rough ground product.

100 parts of the obtained rough ground product, 1.5 parts of sodium dodecylbenzenesulfonate and 1.5 parts of Hitenol EA-177 (HLB value 16; manufactured by DAI-ICHI KOGYO SEIYAKU CO., LTD.) as a surfactant, 2.1 parts of Dimethylaminoethanol, 2 parts of potassium carbonate and 70 parts of de ionized water were added, heated up to 115° C. in a stirring tank of 1 L with, a Maxblend blade, and stirred for 2 hours at a stirring blade speed of 300 rpm. Afterward 160 parts of deionized water was continuously added drop wise at 95° C. for 1 hoar. After finishing adding de ionized, water dropwise, a toner component particle R dispersion was obtained by cooling to normal temperature. When the obtained toner component particles R was measured by SALD 7000 manufactured by Shimazu Corporation, the volume average particles diameter thereof was 0.1 μm.

Production of Toner Dispersing Liquid

After 1.7 parts of the color developing particles A dispersion, 15 parts of the toner component particles R dispersion, and 83 parts of ion-exchange water were mixed and 5 parts of 5% aluminum sulfate aqueous solution was added with stirring at 6,500 rpm by a homogenizer (manufactured by IKA Works Inc.), the temperature of the mixture was raised up to 40° C. with stirring at 800 rpm in a stirring tank of 1 L in which a paddle blade was arranged. After being left at 40° C. for 1 hour, 10 parts of 10% sodium polycarboxylate aqueous solution was added, the mixture was heated up to 68° C. and left for 1 hour, and then a blue toner dispersing liquid was obtained by cooling the resulting mixture.

Evaluation of the Toner

Example 1

After the obtained toner dispersing liquid (the toner solid content 10 kg; the complete color erasing temperature 85° C.) was put into a filter press, the compression pressure was set to 0.25 MPa and washing was performed with 100 kg of ion-exchange water, an air blow was performed while compressing to obtain the toner cake having the amount of water (the water content) of 35 wt %.

Afterward, the drying treatment was performed at the hot air temperature of 50° C. and at the hot air speed of 50 m/s, while adjusting the feed amount so that the amount of toner per unit, airflow was 5 g/m$^3$ by an airflow type dry (a flash jet method,) to obtain the dried toner having the amount of water (the water content) of 0.8%.

After the drying treatment, 2 parts of hydrophobic silica and 0.5 parts of titanium oxide as additive agent, with respect to 100 parts of the obtained dried toner, were adhered, onto the surface of toner particles to obtain the erasable toner. When the particle diameter was measured by Multisizer 3 manufactured by Beckman Coulter, Inc., the 50% volume average particle diameter Dv was 7.5 μm and the number-size distribution of 2.5 μm or less was 9.8% by number. In addition, the complete color erasing temperature of the toner was 85° C. Here, 0.1 g of the obtained toner was placed on a microscope slide, the toner was flattened using a cover glass, the cover glass was heated on a hot plate for 10 minutes, and the complete color erasing temperature was set to a temperature in which the toner was completely erased by visual inspection.

The toner in which the additive agent was added, was mixed with ferrite carrier coated with a silicone resin, and an image was output at the fixing unit temperature of 70° C. by an MFP (e-studio 4520c; manufactured by TOSHIBA TEC CORPORATION). When the image density ID of a color developing image was measured, the image density was 0.65 and it was possible to confirm that the color was not erased in the drying step. On the other hand, by setting the fixing unit temperature to 100° C. and feeding the obtained color developing image at the paper feeding speed of 100 mm/sec, it vas confirmed that the image became colorless, i.e., the desired color was not readily visible to the human eye.

Example 2

After the obtained toner dispersing liquid (the toner solid content 10 kg; the complete color erasing temperature, i.e., the temperature to which an image made using the toner must reach to render the image "invisible", is 85° C.) was put into a filter press, the compression pressure was set to 0.25 MPa and washing was performed with 100 kg of ion-exchange water, an air blow was performed while compressing to obtain a toner cake having the amount of water (the water content) of 35%.

Afterward, drying was performed at an air temperature of 40° C. and at an air speed of 100 m/s, while adjusting the toner particle feed amount so that the amount of toner per unit airflow was 10 g/m$^3$ using an airflow type dry (a flash jet method) to obtain a dried toner having the amount of water (the water content) of 1.1%.

After drying, 2 parts of hydrophobic silica and 0.5 parts of titanium oxide as additive agents, with respect to 100 parts of the obtained dried toner, were adhered onto the surface of toner particles to obtain the erasable toner. When the particle diameter was measured by Multisizer 3 manufactured by Beckman Coulter, Inc., the 50% volume average particle diameter Dv was 7.5 μm and the percentage of particle diameters smaller than 2.5 μm or less was 19.5%. In addition, the complete color erasing temperature of the toner was 85° C.

The toner in which the additive agent was added, was mixed with ferrite carrier coated with a silicone resin, and an image was output at a fixing unit temperature of 70° C. by an MFP (e-studio 4520c; manufactured by TOSHIBA TEC CORPORATION). When the image density (ID) of a color developing image was measured, the image density was 0.66 and it was possible to confirm that the color was not eliminated in the drying step. On the other hand, by setting the fixing unit temperature to 100° C. and feeding the obtained color developing image at the paper feeding speed of 100 mm/sec, it was confirmed that the image became colorless, i.e., the desired color was not readily visible to the human eye.

Example 3

After the obtained toner dispersing liquid (the toner solid content 10 kg; the complete color erasing temperature 85° C.) was put into a filter press, the compression pressure was set to 0.05 MPa and washing was performed with 100 kg of ion-exchange water, an air blow was performed while compressing to obtain the toner cake having the amount of water (the water content) of 56%.

Afterward, the drying was performed using an air temperature of 55° C. and at as air speed of 90 m/s, while adjusting the feed amount of toner particles so that the amount of toner per unit airflow was 3 g/m$^3$ using an airflow type dry (a flash jet method) to obtain dried toner having an amount of water (the water content) of 1.9%.

After the drying treatment, 2 parts of hydrophobic silica and 0.5 parts of titanium oxide as additive agents, with respect to 100 parts of the obtained dried toner, were adhered onto the surface of toner particles to obtain the erasable toner. When the particle diameter was measured by Multisizer 3 manufactured by Bookman Coulter, Inc., the 50% volume average particle diameter Dv was 7.5 μm and the percentage of particles 2.5 μm or less was 7.4%. In addition, the complete color erasing temperature of the toner was 85° C.

The toner in which the additive agent was added, was mixed with ferrite carrier coated with a silicone resin, and an image was output at the fixing unit temperature of 70° C. by an MFP (e-studio 4520c; manufactured by TOSHIBA TEC CORPORATION). When the image density ID of a color developing image was measured, the image density ID was 0.62 and it was possible to confirm, that the color was not eliminated in the drying step. On the other hand, by setting the fixing unit temperature to 100° C. and feeding the obtained color developing image at the paper feeding speed of 100 mm/sec, it was confirmed that the image became colorless, i.e., the desired color was not readily visible to the human eye.

Example 4

After the obtained toner dispersing liquid (the toner solid content having a dry weight of 10 kg; the complete color erasing temperature 85° C.) was put into a filter press, the compression pressure was set to 0.4 MPa and washing was performed with 100 kg of ion-exchange water, an air blow was performed while compressing to obtain the toner cake having the amount of water (the water content) of 29%.

Afterward, the drying treatment was performed at an air temperature of 55° C. and at an air speed of 20 m/s, while adjusting the feed amount of toner particles so that the amount of toner par unit airflow was 1 g/m$^3$ using an airflow type dry (a flash jet method) to obtain the dried, toner having an amount of water (the water content) of 0.9%.

After the drying treatment, 2 parts of hydrophobic silica and 0.5 parts of titanium oxide as additive agents, with respect to 100 parts of the obtained dried toner, were adhered onto the surface of toner particles to obtain the erasable toner. When the particle diameter was measured by Multisizer 3 manufactured by Beckman Coulter, Inc., the 50% volume average particle diameter Dv was 7.5 μm and the percentage of particles 2.5 μm or less was 18.2%. In addition, the complete color erasing temperature of the toner was 85° C.

The toner in which the additive agent was added, was mixed with ferrite carrier coated with a silicone resin, and an image was output at the fixing unit temperature of 70° C. by an MFP (e-studio 4520c; manufactured by TOSHIBA TEC CORPORATION). When the image density ID of a color developing image was measured, the image density was 0.61 and it was possible to confirm that the color was not eliminated in the drying step. On the other hand, by setting the fixing unit temperature to 100° C. and feeding the obtained color developing image at the paper feeding speed of 100 mm/sec, it was confirmed that the image became colorless, i.e., the desired color was not readily visible to the human eye.

Example 5

After the obtained toner dispersing liquid (the toner solid content having a dry weight of 10 kg; the complete color erasing temperature 85° C.) was put into a filter press, the compression pressure was set to 0.25 MPa and washing was performed with 100 kg of ion-exchange water, an air blow was performed while compressing to obtain the toner cake having the amount of water (the water content) of 35%.

Afterward, drying was performed by a vibrating fluid type dryer by setting to the air temperature at 40° C. and the jacket water temperature of 40° C., to obtain dried toner having the amount of water of 1.1%.

After the drying treatment, 2 parts of hydrophobic silica and 0.5 parts of titanium, oxide as additive agents, with respect to 100 parts of the obtained dried toner, were adhered onto the surface of toner particles to obtain the erasable toner. When the particle diameter was measured by Multisizer 3 manufactured by Beckman Coulter, Inc., the 50% volume average particle diameter Dv was 7.5 μm and the percentage of toner particles having a diameter of 2.5 μm or less was 8.7% by number.

The obtained toner was mixed with ferrite carrier coated with a silicone resin, an image was output at the fixing unit temperature of 70° C. by an MFP pa-studio 4520c; manufactured by TOSHIBA TEC CORPORATION). When the image density ID of a color developing image was measured, the image density was 0.65 and it was possible to confirm that the color was not eliminated in the drying step. On the other hand, by setting the fixing unit temperature to 100° C. and feeding the obtained color developing image at the paper feeding speed of 100 mm/sec, it was confirmed that the image became colorless, i.e., the desired color was not readily visible to the human eye.

Comparative Example 1

After the obtained toner dispersing liquid (the toner solid, content having a dry weight of 10 kg; the complete color erasing temperature 85° C.) was put into a filter press, the compression pressure was set to 0.25 MPa and washing was performed with 100 kg of ion-exchange water, an air blow was performed while compressing to obtain the toner cake having the amount of water (the water content) of 35%.

Afterward, drying was performed at an air temperature of 100° C. and at an air speed of 50 m/s, while adjusting the feed amount of toner particles so that the amount of toner per unit airflow was 5 g/m$^3$ by an airflow type dry (a flash jet method) to obtain dried toner having the amount of water (the water content) of 0.7%.

After the drying treatment, 2 parts of hydrophobic silica and 0.5 parts of titanium oxide as additive agents, with respect to 100 parts of the obtained dried toner, were adhered onto the surface of toner particles to obtain the erasable toner. When the particle diameter was measured by Multisizer 3 manufactured by Beckman Coulter, Inc., the 50% volume average particle diameter Dv was 7.5 μm and the percentage of particles having a diameter of 2.5 μm or less was 9.6% by number. In addition, the complete color erasing temperature of the toner was 85° C.

The toner in which the additive agent was added, was mixed with ferrite carrier coated with a silicone resin, and an image was output at the fixing unit temperature of 70° C. by an MFP (e-studio 4520c; manufactured by TOSHIBA TEC CORPORATION). When the image density ID of a color developing image was measured, the image density was 0.31 and thus a part of the color in the toner was eliminated or rendered discolored in the drying step, and thus the color rendering capability of the toner was significantly diminished.

Comparative Example 2

After the obtained toner dispersing liquid (the toner solid content having a dry weight of 10 kg; the complete color erasing temperature 85° C.) was put into a filter press, the compression pressure was set to 0.6 MPa and washing was performed with 100 kg of ion-exchange wafer, an air blow was performed while compressing to obtain the toner cake having the amount of water (the water content) of 26%.

Afterward, drying was performed at an air temperature of 50° C. and an air speed of 50 m/s, while adjusting the feed amount so that the amount of toner per unit airflow was 5 g/m$^3$ by an airflow type dry (a flash jet method) to obtain a dried, toner having the amount of water (the water content) of 0.8%.

After the drying treatment, 2 parts of hydrophobic silica and 0.5 parts of titanium oxide as additive agents, with respect to 100 parts of the obtained dried toner, were adhered onto the surface of toner particles to obtain the erasable toner. When the particle diameter was measured by Multisizer 3 manufactured by Bookman Coulter, Inc., the 50% volume average particle diameter Dv was 7.5 μm and the percentage of toner particles having a diameter of 2.5 μm or less was 25.6%. In addition, the complete color erasing temperature of the toner was 85° C.

The toner in which the additive agent was added, was mixed with ferrite carrier coated with a silicone resin, and an image was output at the fixing unit temperature of 70° C. by an MFP (e-studio 4520c; manufactured by TOSHIBA TEC CORPORATION). When the image density ID of a color developing image was measured, the image density was 0.54, however, toner fog occurred on a non-image part.

According to the present embodiment, toner particles can be effectively dried without generating fracturing of toner the particles which causes a decrease in developing characteristics such as toner scattering and without erasing, eliminating or reducing the intensity or color rendering ability of the coloring material during drying to manufacture an erasable toner.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fail within the scope and spirit of the inventions.

What is claimed is:

1. A method of manufacturing an erasable toner comprising the steps of:

washing and compressing, in a filter press at a compression pressure between 0.05 MPa and 0.4 MPa, toner particles including a coloring material that is erasable by heating to a color erasing temperature and a binder resin to obtain a toner cake having an amount of water between 20% and 60% by weight, wherein the coloring material includes a coloring compound, a developer and a color erasing agent, and is encapsulated by a shell component; and drying the toner cake at a temperature of 40° C. or more and at least 30° C. lower than the color erasing temperature.

2. The method of manufacturing an erasable toner according to claim 1, wherein the drying comprises hot air drying by a flash jet method.

3. The method of manufacturing an erasable toner according to claim 2, wherein a hot air speed in the flash jet method is between from 20 m/s and 100 m/s.

4. The method of manufacturing an erasable toner according to claim 2, wherein the amount of toner being supplied per unit airflow during drying in the flash jet method is between 1 $g/m^3$ and 15 $g/m^3$.

5. The method of manufacturing an erasable toner according to claim 1, further comprising the step of:

incorporating hydrophobic silica and titanium oxide into toner particles obtained after the step of drying the toner cake.

6. A method of making an erasable toner, containing toner particle, comprising:

wet mixing a coloring material, a color developing material, a color erasing agent and a binder resin to form toner particles, the color erasing agent including a discoloring temperature regulating agent and being encapsulated by a shell component;

washing and compressing, in a filter press at a compression pressure between 0.05 MPa and 0.4 MPa, a mixture of the toner particles and water; and drying the resulting mixture such that the resulting mixture has 0.1% by weight to 2.0% by weight of water as a percentage of the total weight of the mixture; wherein no more than 20% of the resulting toner particles have a diameter of less than 2.5 μm; and the mixture is dried without affecting the color rendering capability of the toner.

7. The method of making an erasable toner according to claim 6, wherein, after the washing and compressing step, the resulting mixture has a water content between 20% and 60% by weight.

8. The method of making an erasable toner according to claim 7, wherein the drying step occurs at a drying temperature at least 30° C. lower than the color erasing temperature of the toner, and at a temperature sufficient to dry the mixture to a water content less than 2.0% by weight without diminishing the color rendering capability of the toner.

9. The method of making an erasable toner according to claim 8, wherein the drying step occurs at a temperature of at least 40° C.

10. The method of making an erasable toner according to claim 7, further comprising the step of:

adjusting the liquidity and electrification characteristics of the toner particles.

11. The method of making an erasable toner according to claim 10, wherein the step of adjusting the liquidity and electrification characteristics of the toner particles includes the step of incorporating an inorganic particulates into the mixture after the drying step.

12. The method of making an erasable toner according to claim 10, further comprising the step of:

incorporating resin particles having a diameter of 1 μm or less into the mixture after the step of drying the mixture.

* * * * *